US008460025B2

(12) United States Patent
Segawa et al.

(10) Patent No.: US 8,460,025 B2
(45) Date of Patent: Jun. 11, 2013

(54) DETECTING CONNECTOR

(75) Inventors: Hiroki Segawa, Yokkaichi (JP); Yukihiro Fukatsu, Yokkaichi (JP); Masayasu Fujii, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/362,525

(22) Filed: Jan. 31, 2012

(65) Prior Publication Data

US 2012/0208408 A1 Aug. 16, 2012

(30) Foreign Application Priority Data

Feb. 10, 2011 (JP) ..... 2011-027456

(51) Int. Cl.
*H01R 13/641* (2006.01)

(52) U.S. Cl.
USPC ..... 439/489

(58) Field of Classification Search
USPC ..... 439/489, 357, 358, 488
See application file for complete search history.

(56) References Cited

U.S. PATENT DOCUMENTS

| | | | | |
|---|---|---|---|---|
| 5,120,255 | A * | 6/1992 | Kouda et al. | 439/489 |
| 5,203,718 | A * | 4/1993 | Chishima | 439/489 |
| 6,068,507 | A * | 5/2000 | Popa | 439/489 |
| 6,126,480 | A * | 10/2000 | Kawase et al. | 439/489 |
| 6,824,417 | B1 * | 11/2004 | Nimura | 439/352 |
| 7,591,668 | B2 | 9/2009 | Nakamura | |
| 7,980,880 | B2 * | 7/2011 | Kodama et al. | 439/352 |

* cited by examiner

*Primary Examiner* — Tulsidas C Patel
*Assistant Examiner* — Phuongchi Nguyen
(74) *Attorney, Agent, or Firm* — Gerald E. Hespos; Michael J. Porco; Matthew T. Hespos

(57) ABSTRACT

A flexing strip (41) is formed on a housing (20). An interference part (63) is formed on a fit-on detector (50). A distinguishing part (46) having a color different from the fit-on detector (50) is formed on the flexing strip (41). The flexing strip (41) interferes with the interference part (63) and deforms while moving the fit-on detector (50) from a wait position to a detection position. The flexing strip (41) is released from an interference state with the interference part (63) and elastically restores to its original state when the fit-on detector (50) has reached the detection position. A position of the distinguishing part (46) relative to the interference part (63) changes before and after a flexing of the flexing strip (41) so that the distinguishing part (46) is exposed and can be seen from a distinguishing position.

10 Claims, 9 Drawing Sheets

DETECTING CONNECTOR

BACKGROUND OF THE INVENTION

1. Field of the Invention

The invention relates to a connector.

2. Description of the Related Art

U.S. Pat. No. 7,591,668 discloses a connector having a housing that can be fit on a mating housing. A fit-on detector is mounted on the housing and is movable between a wait position and a detection position. The fit-on detector is held at the wait position in the process of fitting the housings together and is allowed to move to the detection position when the housings have been fit together. Therefore it is possible to know that the housings have been fit together properly when the fit-on detector has reached the detection position.

A window is formed on the fit-on detector. Different colors are applied to the fit-on detector and the housing. At the wait position, the color of the fit-on detector is visible through the window. The color of the housing is visible through the window when the fit-on detector is at the detection position. Therefore, it is possible to determine that the fit-on detector has reached the detection position when the background color inside the window has changed to the color of the housing. On the other hand, it is possible to determine that the fit-on detector has not reached the detection position when the background color inside the window remains the color of the fit-on detection member.

The background color in the window of the above-described connector changes according to a moving speed of the fit-on detector. Therefore the color changes slowly, and the connector lacks clarity.

The invention was made based on the above-described situation and has for its object to clearly distinguish whether a fit-on detector has reached a detection position.

SUMMARY OF THE INVENTION

The invention relates to a connector with a housing that can fit on a mating housing. A fit-on detector is mounted on the housing for movement between a wait position and a detection position. The fit-on detector is held in the wait position in a process of fitting the housing and the mating housing together, and is allowed to move to the detection position when the housing and the mating housing have been fit together properly. A flexing strip is formed on one of the housing and the fit-on detector and an interference part is formed on other of the housing and the fit-on detector. A distinguishing part is formed on the flexing strip and has a color different from the color of the housing or the fit-on detector that has the interference part. The flexing strip interferes with the interference part in a process of moving the fit-on detector from the wait position to the detection position and is deformed elastically. The flexing strip is released from the interference part and is restored elastically to an original state when the fit-on detector has reached the detection position. The distinguishing part is disposed relative to the interference part to change before and after the flexing strip performs a flexing operation. Thus, the distinguishing part is exposed or hidden due to the elastic operation of the flexing strip when seen from the distinguishing position so that the color of the distinguishing part changes rapidly. Accordingly, whether the fit-on detector has reached the detection position can be distinguished clearly.

The distinguishing part interferes with the interference part in the process of moving the fit-on detector from the wait position to the detection position. The distinguishing part rides across the interference part at the detection position and is exposed so that the distinguishing part can be seen from the distinguishing position. Thus, whether the fit-on detector has reached the detection position can be distinguished clearly.

The entire flexing strip preferably always is exposed outside. Thus, a flexing strip that remains flexed can be seen and indicates that the fit-on detector has not reached the detection position.

The flexing strip preferably is formed on the housing, and a guide space preferably is formed between the flexing strip and a surface of the housing. The fit-on detector is guided in the guide space during a movement of the fit-on detector. This guide construction is simpler than a guide construction for guiding the fit-on detector that is formed separately from the flexing strip.

An opening preferably is formed on the surface of the housing for exposing a plurality of terminal fittings accommodated in the housing. A short circuit terminal is accommodated in the fit-on detector at a position opposed to the surface of the housing. The short circuit terminal contacts a pair of terminal fittings through the opening at the wait position and is released from the pair of terminal fittings at the detection position. The disposition of the short circuit terminal on the fit-on detector enables the short-circuited state of the terminal fittings to be released by the movement of the fit-on detector. Consequently it is unnecessary to form a construction for releasing the short-circuited state on the mating housing.

The short circuit terminal preferably functions as a detection terminal for opening a detection circuit at the detection position. The use of the short circuit terminal as the detection terminal is simpler than a construction with a separate detection terminal.

The interference part preferably contacts the flexing strip at the wait position to prevent movement of the fit-on detector to the detection position. Therefore it is unnecessary to provide a separate movement prevention construction for preventing movement of the fit-on detector to the detection position. The movement prevention construction provides a more reliable holding of the fit-on detector at the wait position in the movement-prevented state.

The interference part preferably contacts the flexing strip at the detection position to prevent a return movement of the fit-on detection member to the wait position. Therefore it is unnecessary to form a separate return prevention construction for preventing the return movement of the fit-on detector to the wait position. The return prevention construction provides a more reliable holding of the fit-on detector at the detection position in the return movement-prevented state.

An operation surface preferably is formed on the fit-on detector and is pressed from the wait position toward the detection position. The distinguishing part preferably is alongside the operation surface. The disposition of the distinguishing part alongside the operation surface ensures that an operator's fingers will not interfere with the distinguishing part. Additionally, the distinguishing part is positioned in the direction in which the operator presses the operation surface. Thus, the distinguishing part is easily visible from the distinguishing position where the operator stands.

Flexing strips preferably are formed at both sides of the housing in a width direction and to-be-guided parts are formed at both lateral sides of the operation surface on the fit-on detector. The to-be-guided parts are slid into the guide space between the flexing strip and a surface of the housing. Therefore the pressed fit-on detector can be guided smoothly and securely to the detection position without a position gap.

DETAILED DESCRIPTION OF THE PREFERRED EMBODIMENTS

Figure 1:
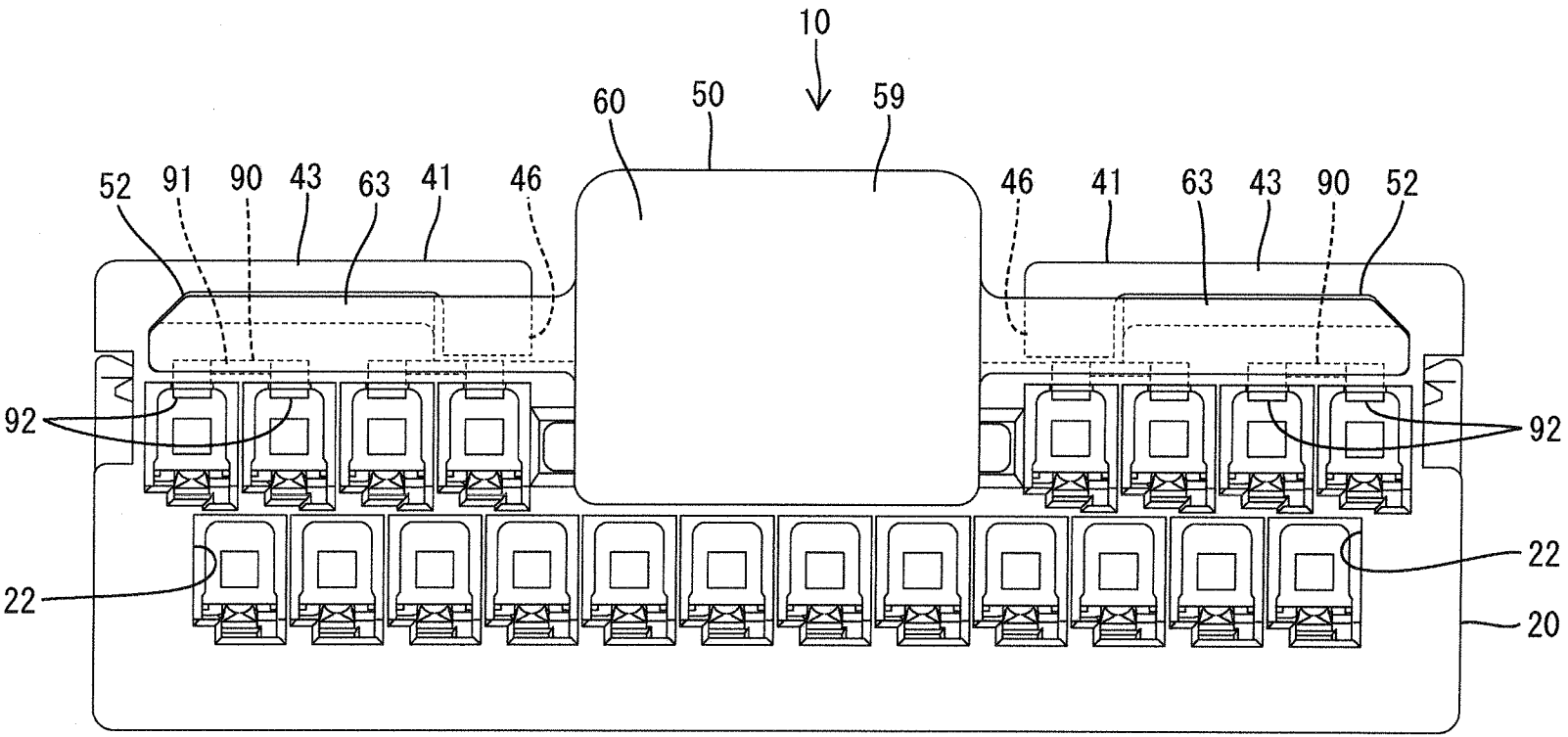
FIG. 1 is a rear view of a connector in accordance with the invention where a fit-on detector is held at a wait position.
Figure 2:
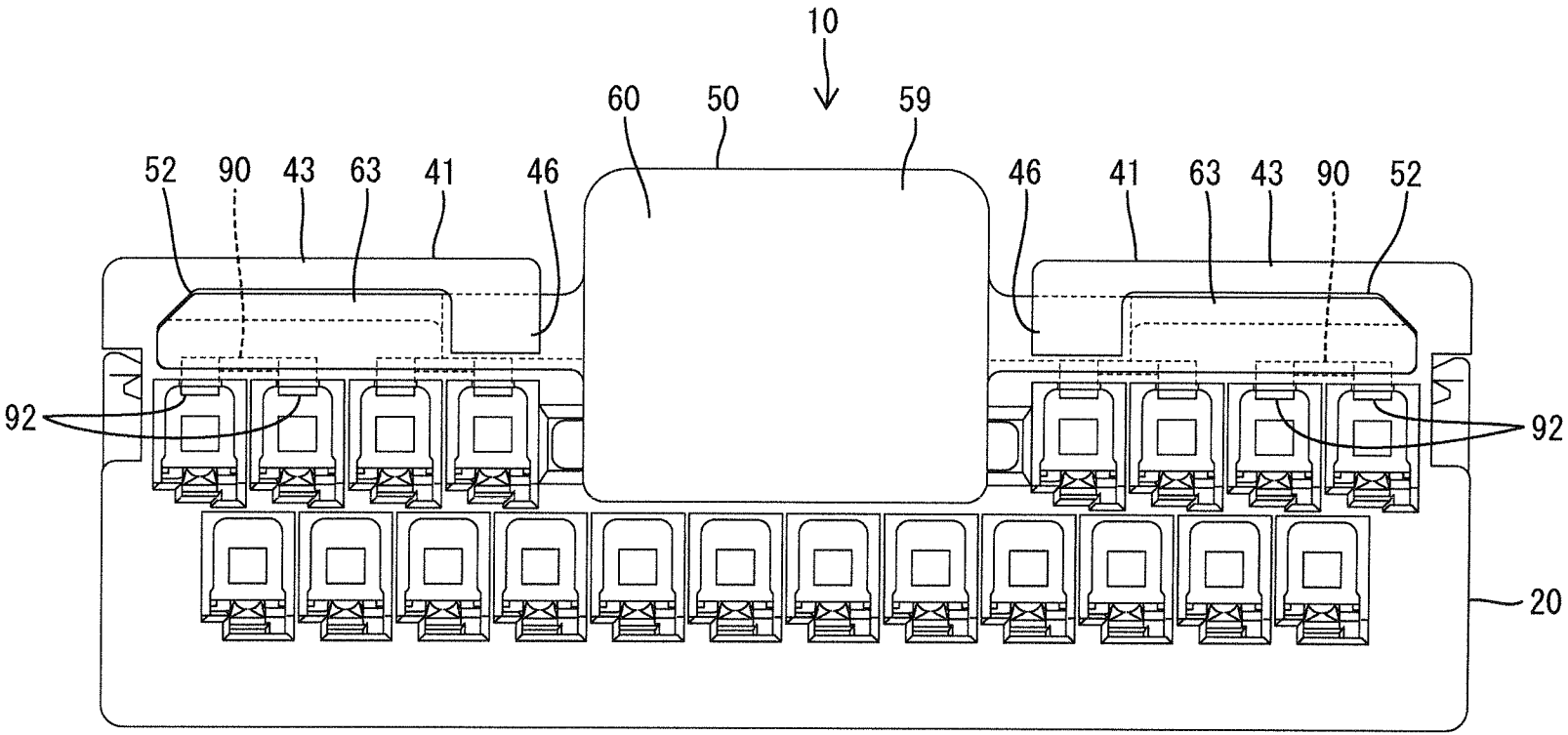
FIG. 2 is a rear view showing the fit-on detector held at a detection position.

A connector in accordance with the invention is identified by the numeral 10 in FIGS. 1 through 7. The connector 10 has a housing 20, a fit-on detector 50, a terminal fitting 80, and a short circuit terminal 90. The housing 20 can be fit on a mating housing 100. The fit-on ends of both housings 20 and 100 are referred to herein as the front ends.

Figure 7:
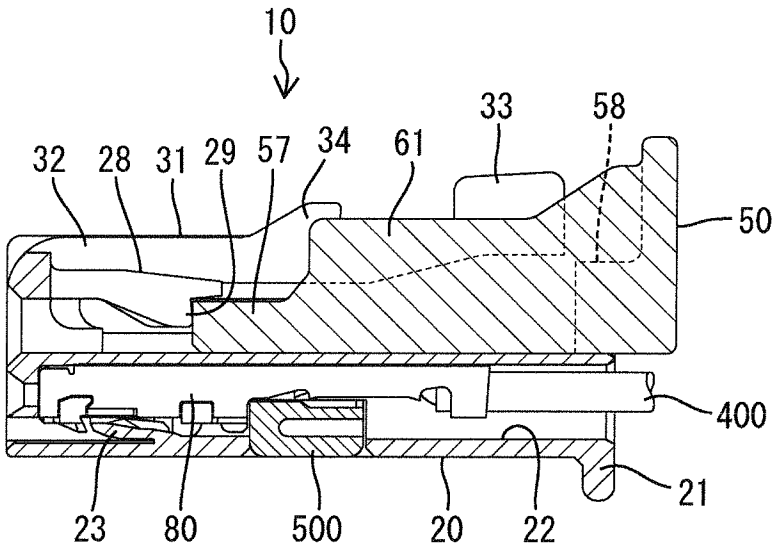
FIG. 7 is a sectional view showing a housing and a mating housing confronting each other.
Figure 7:
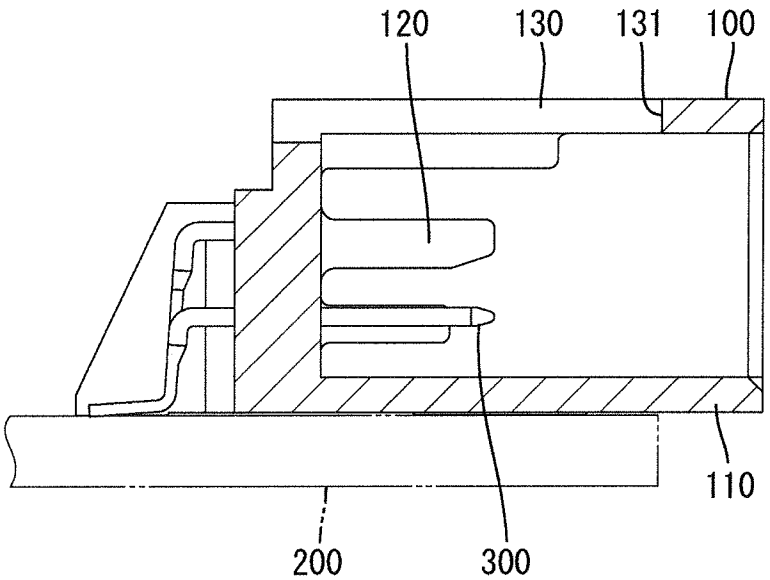

The mating housing 100 is made of a synthetic resin. As shown in FIG. 7, the mating housing 100 has a quadrangular prism-shaped hood 110 and is soldered to a surface of a printed circuit board 200 via a metal peg (not shown in the drawings) mounted on the hood 110. Male terminal fittings 300 are mounted through a rear wall of the hood 110. One end of each male terminal fitting 300 projects into the hood 110 and electrically connects to the mating terminal fitting 80 when both housings 20 and 100 have been fit together. The other end of each male terminal fitting 300 projects rearward from the rear wall of the hood 110 and connects electrically to an unshown electrically conducting path formed on the surface of the printed circuit board 200.

Left and right release strips 120 project forward from laterally intermediate parts of the rear wall of the hood 110 in the lateral direction. A locking hole 130 penetrates through a laterally central part of an upper wall of the hood 110. The locking hole 130 extends in the forward and backward direction of the hood 110 and opens at a rear end thereof. A to-be-locked surface 131 is formed at the front end of the locking hole 130.

The housing 20 is made of the synthetic resin and has a square block-shaped housing body 21 that can be fit in the hood 110. Cavities 22 are formed in the housing body 21 at positions corresponding to the male terminal fittings 300. The cavities 22 are constructed of upper and lower stages at both left and right sides of the housing body 21 in its width direction and the lower stage at a central portion of the housing body 21 in its width direction. A lance 23 projects forward from a lower surface of an inner wall of each cavity 22. The lance 23 prevents removal of a terminal fitting 80 that has been inserted properly into the cavity 22 from the rear.

Figure 5:
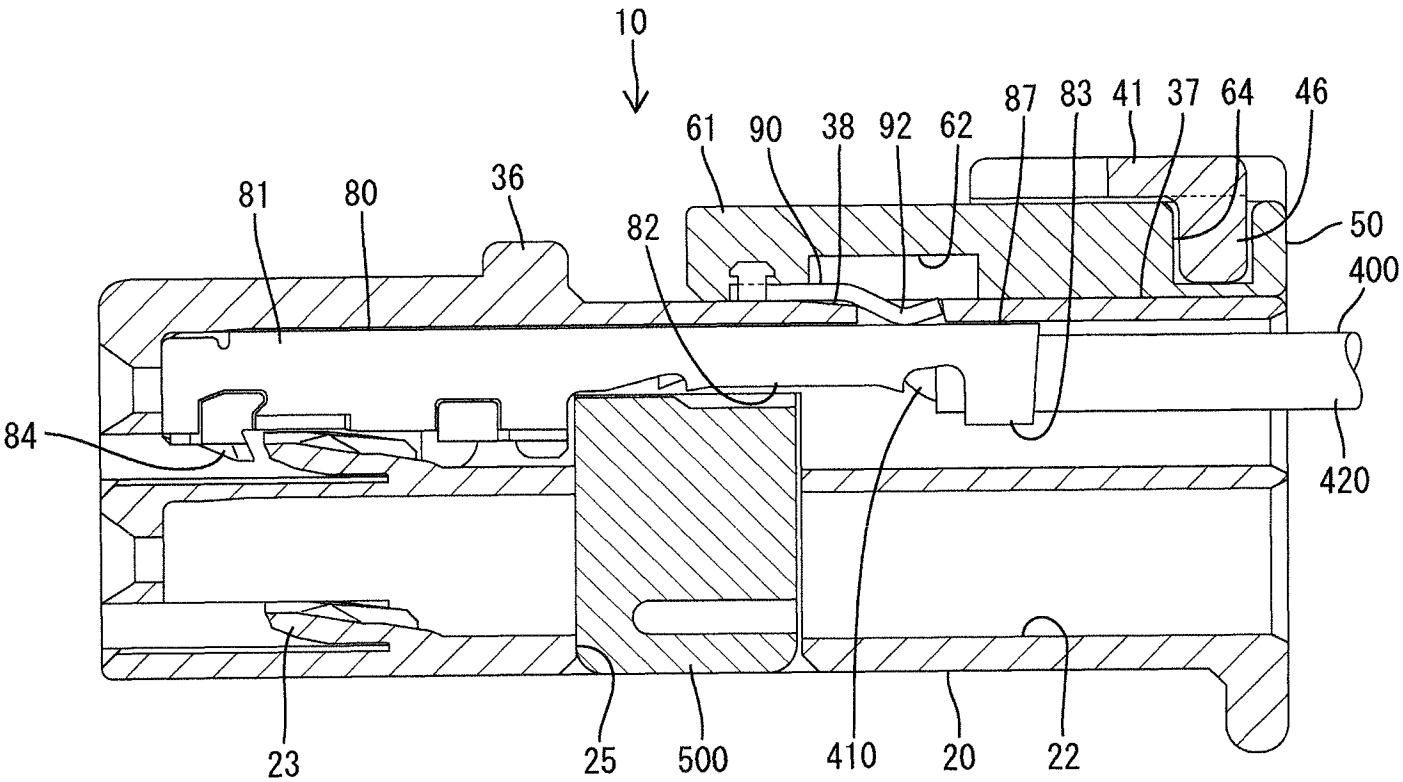
FIG. 5 is a sectional view showing the fit-on detector held at the wait position, and a terminal fitting short-circuited.
Figure 6:
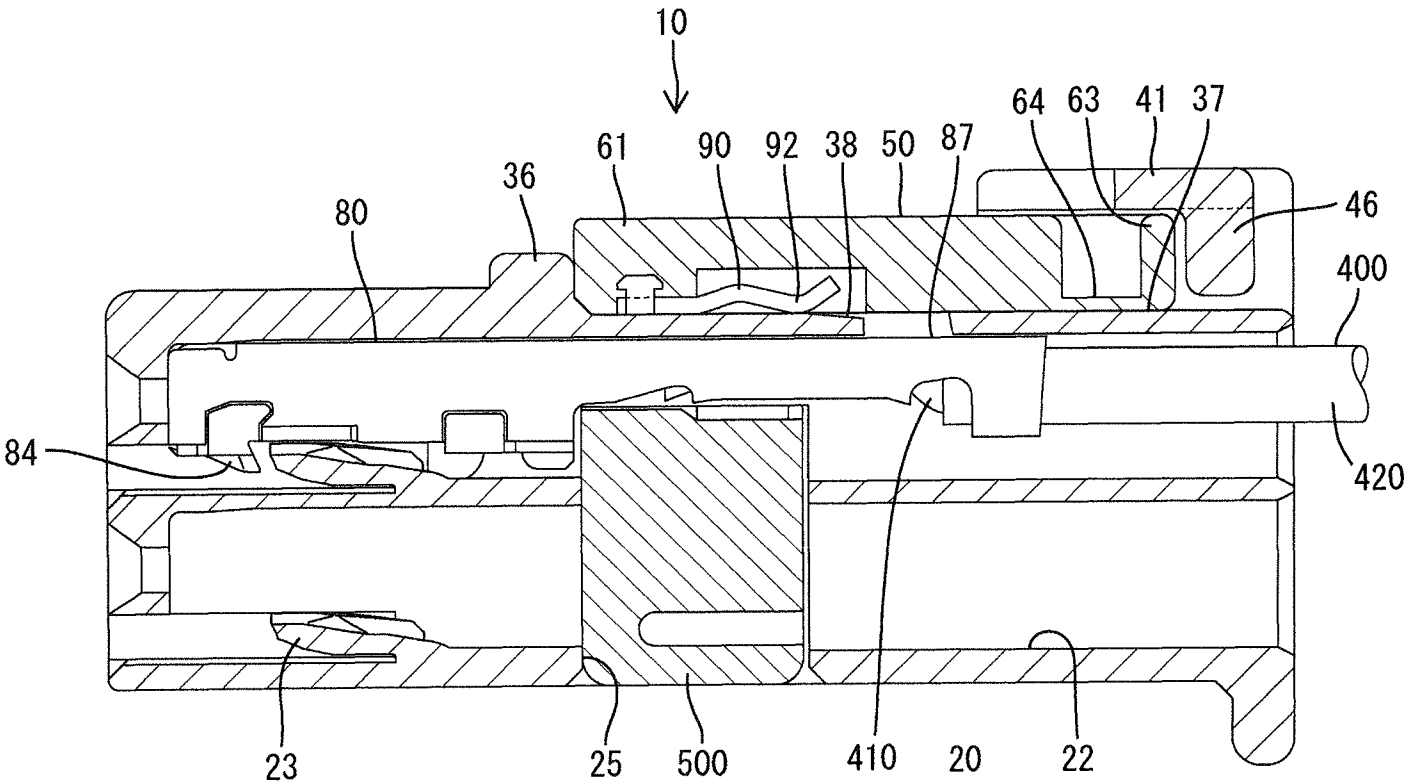
FIG. 6 is a sectional view showing a state the fit-on detector held at the detection position, and the terminal fitting released from a short-circuited state.

The terminal fitting 80 is formed unitarily by bending a conductive metal plate. As shown in FIG. 5, the terminal fitting 80 has an approximately quadrangular prism-shaped terminal body 81 and open barrel-shaped barrel parts 82, 83 continuous with a rear portion of the terminal body 81. The mating male terminal fitting 300 is inserted into the terminal body 81 and connected thereto, when both housings 20 and 100 are fit together. A to-be-locked part 84 projects down from the terminal body 81 and can be locked to the lance 23. The wire barrel 82 is crimped to a core 410 at an end of an electric wire 400. The insulation barrel 83 is crimped to a coating 420 near an end of the electric wire 400. The terminal fitting 80 to be inserted into the upper-stage cavity 22 is disposed by orienting a bottom 87 of the wire barrel 82 and the insulation barrel 83 upward.

A retainer-mounting hole 25 is formed on a lower surface of the housing body 21 and has a depth that leads to the cavities 22. A retainer 500 is insertable into the retainer-mounting hole 25 so that the terminal fitting 80 is held redundantly by the lance 23 and the retainer 500 inserted into the retainer-mounting hole 25.

Figure 9:
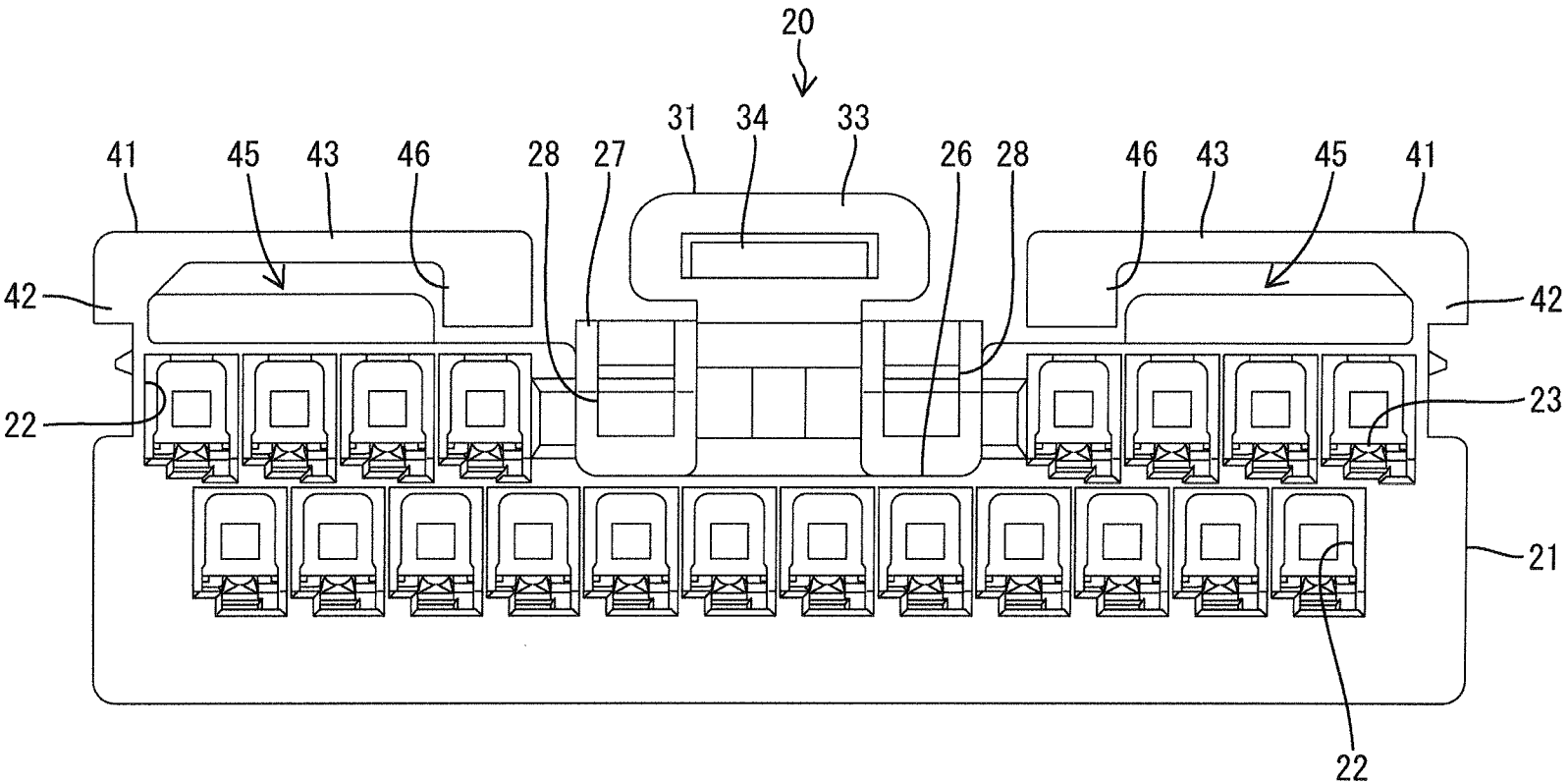
FIG. 9 is a rear view of the housing.

As shown in FIG. 9, a concavity 26 is formed on an upper surface of the housing body 21 at an approximately central widthwise position. The concavity 26 is sunken to some extent from both lateral sides of the housing body 21. The concavity 26 is on a level with the upper-stage cavities 22 and disposed between the left and right upper-stage cavities 22 with the concavity 26 extending in forward and backward directions of the housing body 21 and being open at a rear end. A plate-shaped base wall 27 is formed at the front end of the upper surface of the housing body 21 and closes the front of the concavity 26. Two elastic locks 28 project rearward into the concavity 26 from lateral sides of a rear surface of the base wall 27. As shown in FIG. 7, a holding projection 29 is formed on a lower surface of the elastic lock 28 near the projecting end thereof.

A locking arm 31 is accommodated in the concavity 26 of the housing body 21 and between the elastic locks 28. The locking arm 31 has an arm body 32 that is integral with and erect from an upper end of the base wall 27 and extends rearward. An operation part 33 is raised from the free rear end portion of the arm body 32. A locking projection 34 projects from an upper surface of the arm body 32 at a central portion in the length direction. The locking projection 34 interferes with the front end of the upper wall of the hood 110 in the process of fitting the housings 20 and 100 together. Thus, the arm body 32 deforms elastically about a portion where the arm body 32 joins the base wall 27 and enters the concavity 26. The arm body 32 elastically returns to its original state when the housings 20 and 100 have been fit together properly and the locking projection 34 is fit into the locking hole 130 from below to hold the housings 20 and 100 in a fit-on state. On the other hand, the operation part 33 can be pressed into the concavity 26 to deform the arm body 32 elastically. As a result, the locking projection 34 separates from the locking hole 130 so that the housings 20 and 100 can be separated from each other.

Figure 3:
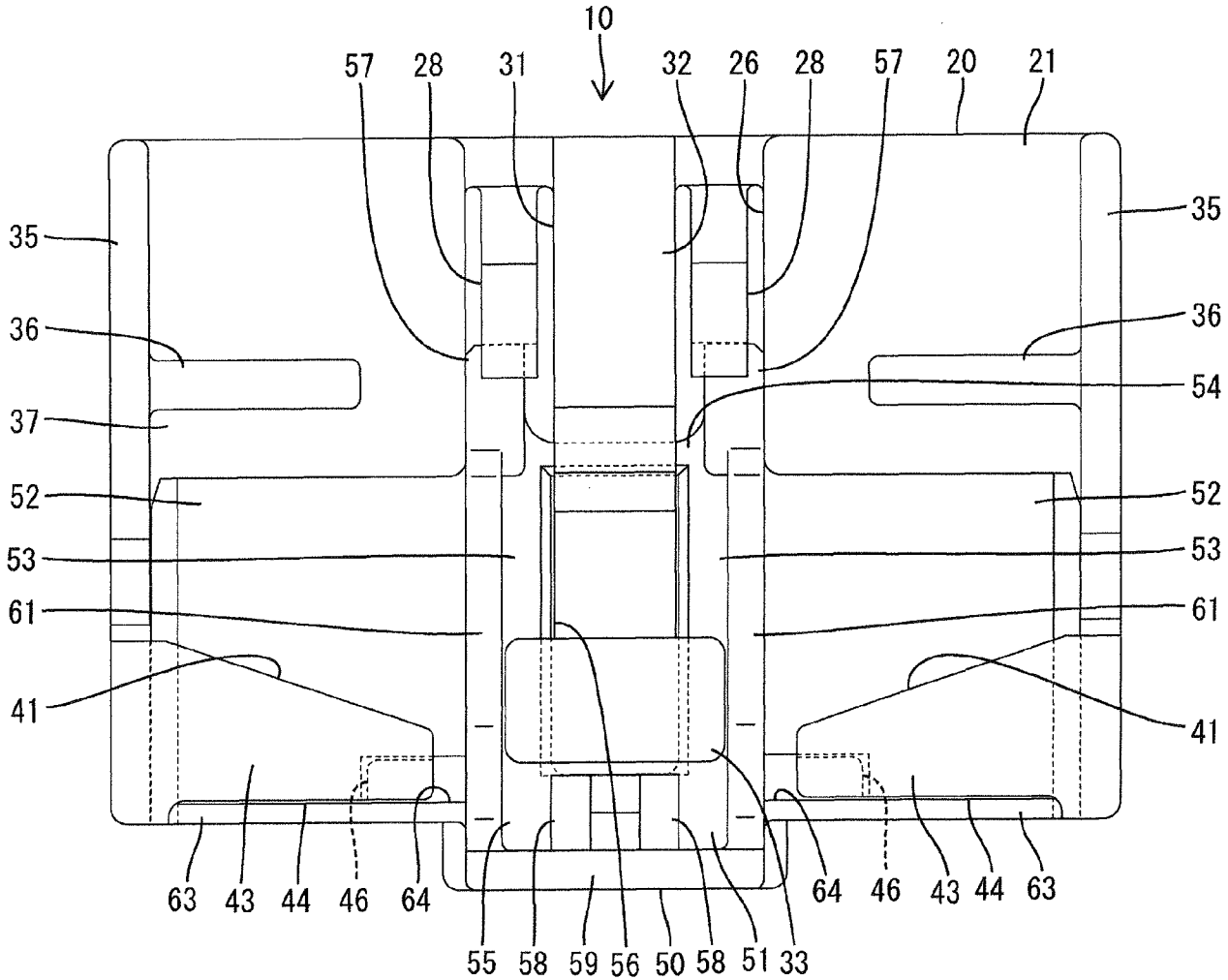
FIG. 3 is a plan view showing the fit-on detector held at the wait position.
Figure 4:
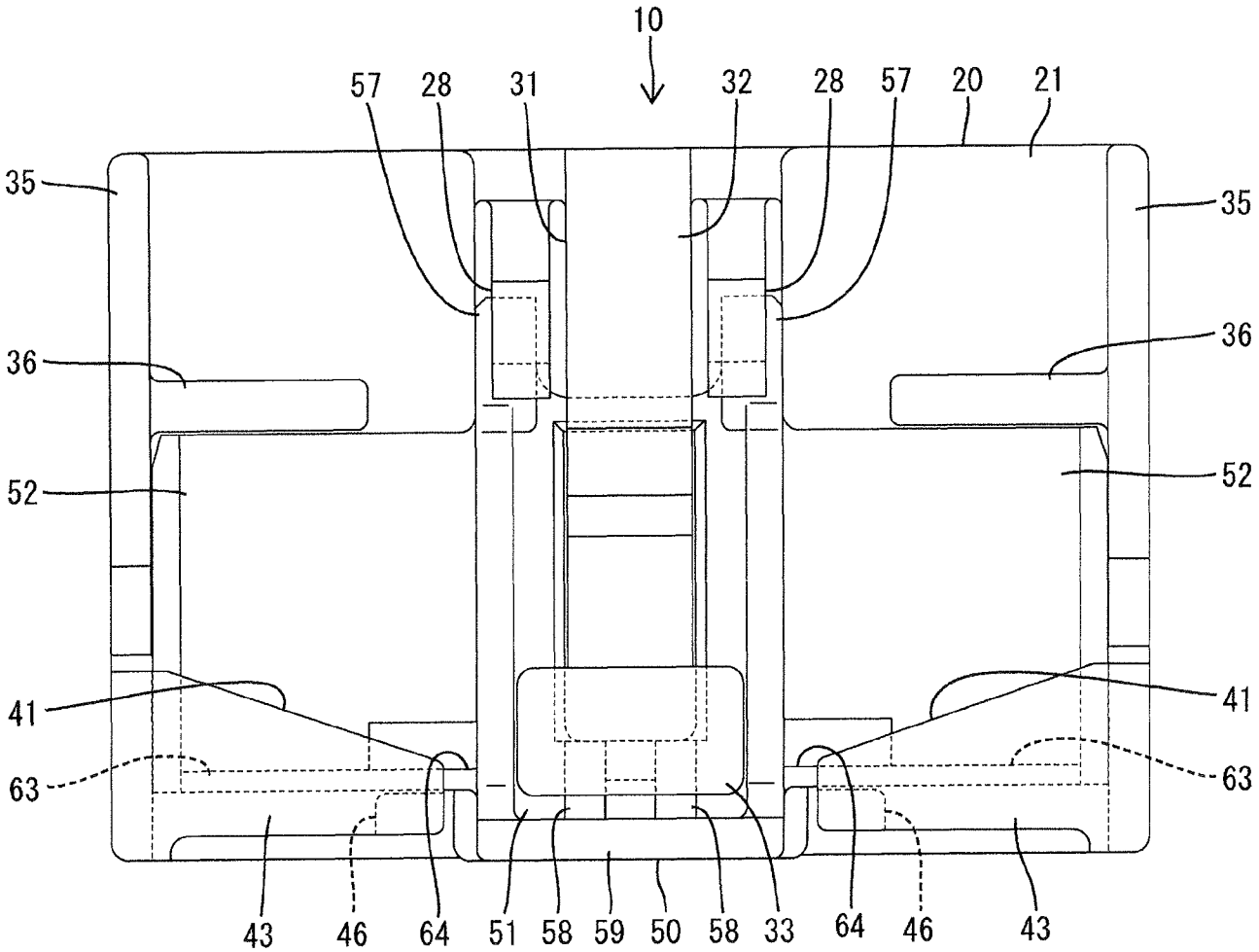
FIG. 4 is a plan view showing the fit-on detector at the detection position.

As shown in FIG. 3, left and right guide ribs 35 are formed on the upper surface of the housing body 21 at both side edges in the width direction and extend in the forward and backward direction of the housing body 21 and convex parts 36 extend perpendicularly in from the guide ribs 35. A sliding surface 37 is formed on a portion of the upper surface of the housing body 21 rearward of the convex parts 36 and is sunken from a portion of the upper surface of the housing body 21 forward of the convex parts 36. The fit-on detection member 50 is slidable along the sliding surface 37.

Figure 8:
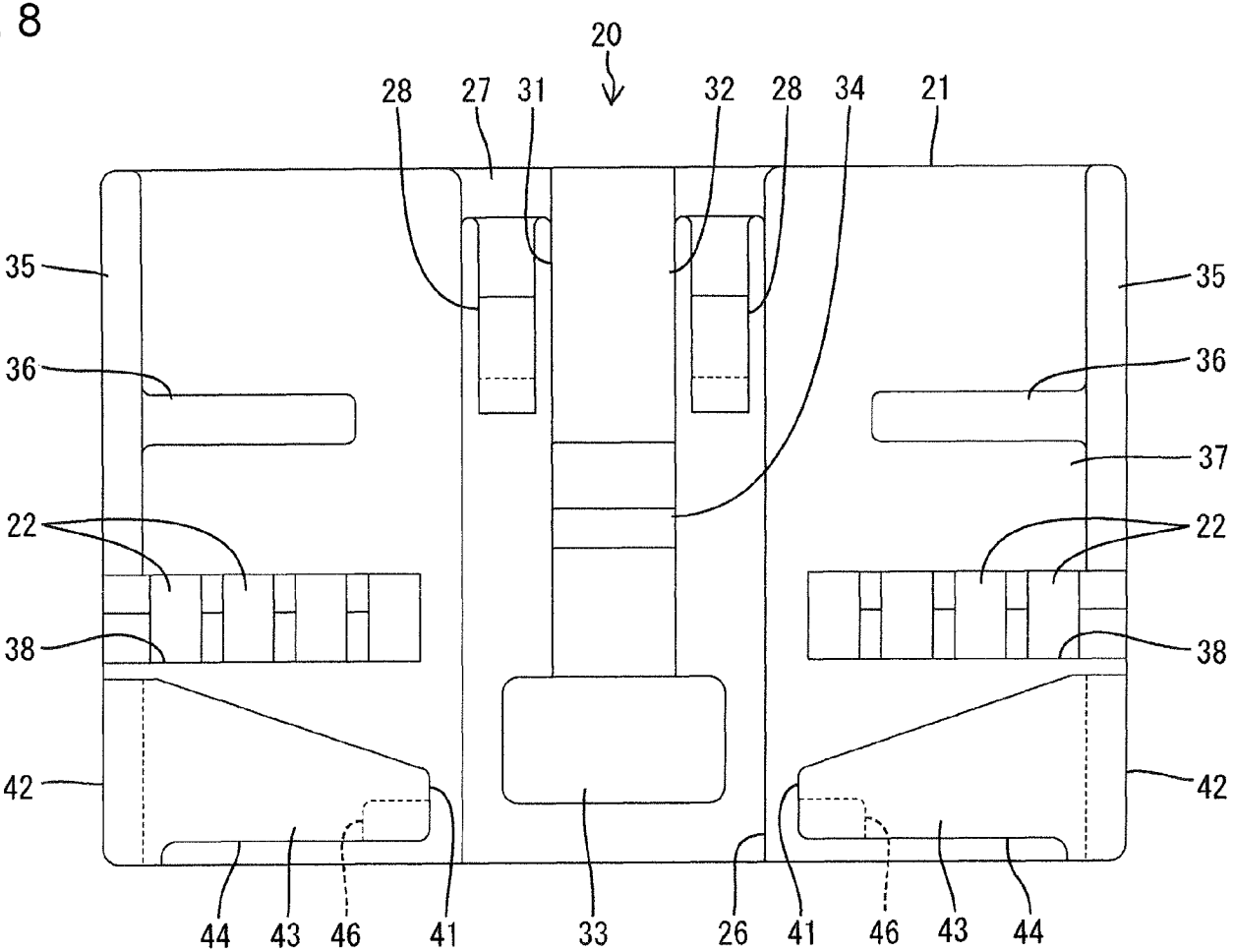
FIG. 8 is a plan view of the housing.

As shown in FIG. 8, two openings 38 are formed through the sliding surface 37 of the housing body 21 and extend in the width direction of the housing body 21. The upper-stage cavities 22 are exposed outside through the openings 38. Bottom portions 87 of the terminal fittings 80 inserted into the upper-stage cavities 22 face the openings 38. A run-on guide surface is formed on the sliding surface 37 of the housing body 21 and gradually descends toward front edges of the openings 38. The short circuit terminal 90 slides along the run-on guide surface to guide an operation of allowing the short circuit terminal 90 to ride on the sliding surface 37.

Left and right flexing strips 41 are formed integrally with the upper surface of the housing body 21. Each flexing strip 41 has a proximal part 42 erect from the respective side edge of the sliding surface 37 and a flexing strip body 43 projected from an upper end of the proximal part 42 toward the center of the housing body 21 in the width direction. The flexing strip body 43 is elastically deformable in the vertical direction of the housing body 21 about the proximal part 42. Both flexing strips 41 are exposed on the upper surface of the housing 20.

Each flexing strip body 43 is a flat plate with a dimension in front to back direction that gradually decreases toward more inward positions. The projected end of each flexing strip body 43 is disposed near the concavity 26. A release concavity 44 is formed on a rear edge of each flexing strip body 43. As shown in FIG. 9, a guide space 45 is defined by the proximal part 42, the flexing strip body 43, and the sliding surface 37 of the housing body 21 and is open in the forward and backward direction of the housing body 21. The fit-on detector 50 is inserted into the guide space 45 from the rear. The flexing strip body 43 prevents the fit-on detector 50 from escaping upward and the proximal part 42 prevents the fit-on detector 50 from moving freely laterally.

A distinguishing part 46 projects down into the guide space 45 from the rear edge of the projected end of each flexing strip body 43. The distinguishing part 46 is approximately square-shaped in a rear view and is easily visible when the distinguishing part 46 is seen from the rear of the housing body 21.

The fit-on detector 50 is made of a synthetic resin and has a color different from the color of the housing 20. As described later, when the connector 10 is seen from a distinguishing position where an operator stands, the operator can distinguish a color contrast between the distinguishing part 46 and the housing 20.

The fit-on detector 50 is mounted on the housing 20 from the rear and can be moved in the forward and backward direction between a wait position and a detection position along the sliding surface 37. More specifically as shown in FIG. 3, the fit-on detector 50 has a detector body 51 that can penetrate into the concavity 26 and two to-be-guided parts 52 that protrude laterally from both side edges of the detector body 51.

The detector body 51 has two parallel side frame parts 53 that extend in the forward and backward direction of the fit-on detector 50, a front frame part 54 that connects front ends of the side frame parts 53 to each other, and a rear frame part 55 that connects rear ends of the side frame parts 53 to each other. An approximately square release hole 56 penetrates the detector body 51 inward of the side frame parts 53, the front frame part 54 and the rear frame part 55. The arm body 32 is capable of penetrating into the release hole 56 when the locking arm 31 is deformed elastically in the process of fitting the housings 20 and 100 together. Left and right approximately quadrangular prism-shaped contacts 57 project forward from front ends of both side frame parts 53. The fit-on detector 50 is prevented from moving to the detection position when the contacts 57 contact the rear ends of the holding projections 29 of the elastic locks 28.

Left and right flexure prevention parts 58 project forward from an upper surface of the rear frame part 55. Both flexure prevention parts 58 move below the operation part 33 of the locking arm 31 when the fit-on detector 50 has reached the detection position to prevent an inadvertent flexing of the locking arm 31. A flat plate-shaped cover 59 is erect from the rear of the upper surface of the rear frame part 55. The cover 59 is approximately rectangular in a rear view and is disposed to cover the rear end of the operation part 33 of the locking arm 31 in mounting the fit-on detector 50 on the housing 20. An operation surface 60 is defined on the rear of the cover 59 and can be pressed forward to move the fit-on detector 50 to the detection position. Left and right flat plate-shaped side walls 61 are formed on the side frame parts 53 and extend along the height direction and the forward and backward direction of the fit-on detector 50. Rear ends of the left and right side walls 61 are continuous with a front surface of the cover 59.

Flat plate-shaped to-be-guided parts 52 project laterally from approximately a central portion of outer surfaces of both side walls 61 in the height direction and are disposed at left and right sides of the locking arm 31. The to-be-guided parts 52 are approximately rectangular in plan view and can cover the entire sliding surface 37 of the housing body 21. As shown in FIG. 5, a bottomed mounting concavity 62 is formed on lower surfaces of both to-be-guided parts 52 for receiving short circuit terminals 90.

The short circuit terminal 90 is made of a metal plate to include a coupling 91 and left and right contact strips 92 that project from both widthwise sides of the coupling 91, as shown in FIG. 1. The coupling 91 is press-fit into the mounting concavity 62. The contact strips 92 contact the terminal fittings 80 that are adjacent in the width direction in the upper-stage cavities 22 when the fit-on detector 50 is at the wait position. Thus, the terminal fittings 80 are short-circuited by the short circuit terminal 90. On the other hand, the contact strips 92 are separated from the terminal fittings 80 when the fit-on detector 50 is at the detection position. Therefore, the short-circuited state of the terminal fittings 80 is released at the detection position. Four short circuit terminals 90 are provided in this embodiment and act on all of the terminal fittings 80 in the upper-stage cavities 22.

Left and right interference parts 63 projecting at the rear edges of the upper surfaces of the to-be-guided parts 52 and extend in the width direction of the fit-on detector 50. The interference parts 63 can interfere with the distinguishing part 46 of the flexing strip 41 when the fit-on detector 50 has been mounted on the housing body 21. Engaging concavities 64 are formed on the upper surfaces of the to-be-guided parts 52 immediately forward from the interference parts 63 and corresponding to the distinguishing part 46. The distinguishing part 46 is fit in the engaging concavity 64 and can be locked thereto when the fit-on detector 50 is at the wait position.

The fit-on detector 50 is inserted into the housing 20 from the rear. As a result, the detector body 51 is inserted into the concavity 26, and the to-be-guided parts 52 are inserted into the guide space 45 so that the to-be-guided parts 52 cover the sliding surface 37 and close the opening 38 is closed with the to-be-guided parts 52.

The contacts 57 contact the holding projections 29 of the elastic locks 28 from the rear when the fit-on detector 50 has reached the wait position. At this time, the interference parts 63 penetrate into the release concavities 44 from the rear and contact the distinguishing parts 46 of the flexing strips 41 from the rear. Thus, the fit-on detector 50 is prevented from being pressed further forward (see FIGS. 3 and 7). At the wait position, the distinguishing parts 46 of the flexing strips 41 are fit elastically in the engaging concavities 64 of the to-be-guided parts 52 from above. Hence, the fit-on detector 50 is prevented from being removed rearward from the housing 20. At this time, the rear part of the fit-on detector 50 projects rearward beyond the rear end surface of the housing 20.

At the wait position, the short circuit terminals 90 mounted on the to-be-guided parts 52 are disposed to ride astride a pair of the terminal fittings 80, and the contact strips 92 of the short circuit terminals 90 penetrate into the cavities 22 through the openings 38. Thus, the contact strips 92 contact the bottoms 87 of a pair of the terminal fittings 80 respectively to short the terminal fittings 80 (see FIG. 5). The to-be-guided parts 52 entirely cover the upper-stage cavities 22 so that all of the terminal fittings 80 in the upper-stage cavities 22 are short-circuited.

Thereafter the housing 20 and the mating housing 100 are confronted to each other and fit together. The locking arm 31 deforms elastically in the process of fitting both housings 20 and 100 together. The locking projection 34 is fit in the locking hole 130 when the housings 20 and 100 have been fit together so that the housings 20 and 100 cannot be separated. In this case, the arm body 32 of the locking arm 31 is displaced and penetrates into the release hole 56 of the fit-on detector 50 to avoid interference between the locking arm 31 and the fit-on detector 50. The terminal fitting 80 is connected electrically to the mating male terminal fitting 300 at a normal depth when the housings 20 and 100 have been fit properly together. Additionally, the release strips 120 of the mating housing 100 contact the holding projections 29 of the elastic locking parts 28 from the front when the housings 20 and 100 have been fit together properly, thereby elastically deforming the elastic locking parts 28 up. As a result, the locked state of the holding projection 29 and the contact 57 is released, and the fit-on detector 50 can move forward to the detection position.

On the other hand, the release strips 120 do not reach the holding projections 29 of the elastic locking parts 28, and the holding projections 29 remain locked to the contact 57, if the housings 20 and 100 are not fit together properly and remain in a semi-fit-on state. Therefore the fit-on detector 50 cannot move to the detection position and remains at the wait position. Hence, an ability to move the fit-on detector 50 to the detection position indicates that the housings 20 and 100 have been fit together properly. On the other hand, an inability to move the fit-on detector 50 to the detection position indicates that the housings 20 and 100 have not been fit together properly.

When the housings 20 and 100 have been fit together properly, the operation surface 60 of the cover 59 is pressed from the rear so that the fit-on detector 50 reaches the detection position. In the process of moving the fit-on detector 50 to the detection position, the to-be-guided parts 52 slide on the sliding surface 37 with the movement of the to-be-guided parts 52 being guided inside the guide space 45. Thus, the movement of the fit-on detector 50 can be accomplished easily. Each short circuit terminal 90 follows the movement of the fit-on detector 50 to the detection position and makes a displacement. That is, each short circuit terminal 90 rides on the sliding surface 37 of the housing 20 with each contact strip 92 moving away from the opening 38 and being guided by the run-on guide surface (see FIG. 6) to release the short-circuited state of the terminal fittings 80.

In the case where a detection circuit is provided with the short circuit terminal 90, the detection circuit is closed by two of the terminal fittings 80 when the fit-on detector 50 is at the wait position. The detection circuit is opened with the release of the short-circuited state of the terminal fittings 80 when the fit-on detector 50 is at the detection position. Therefore, the short circuit terminal 90 is a detection terminal in addition to its original function.

The distinguishing parts 46 of the flexing strips 41 interfere with the interference parts 63 at the final stage of moving the fit-on detector 50 to the detection position. As a result, the flexing strip bodies 43 deform up so that the distinguishing parts 46 ride across the interference parts 63. The flexing strip bodies 43 elastically return to their original states when the fit-on detector 50 reaches the detection position. Thus, the distinguishing parts 46 contact the interference parts 63 from the rear (see FIGS. 2 and 4) to prevent a return movement of the fit-on detector 50 to the wait position. The front edges of the to-be-guided parts 52 contact the convex parts 36 from the rear at the detection position to prevent the fit-on detector 50 from being pressed further forward. The flexure prevention parts 58 penetrate the flexing space of the locking arm 31 at the detection position to prevent flexing of the locking arm 31. At the detection position, the cover 59 completely covers the rear of the operation part 33 of the locking arm 31 with the operation surface 60 of the cover 59 being almost flush with the rear end surface of the housing 20.

Different colors are applied to the housing 20 and the fit-on detector 50. Let it be supposed that the operator stands at the distinguishing position. When the fit-on detector 50 is at the wait position, the operator at the distinguishing position can see the entire rear edge of the to-be-guided part 52 at both sides of the operation surface 60 of the fit-on detector 50 in its width direction, but cannot see the distinguishing part 46. That is, the distinguishing part 46 is hidden behind the to-be-guided parts 52.

As soon as the fit-on detector 50 moves from the wait position to the detection position, the distinguishing part 46 is exposed at a position forward from the to-be-guided parts 52 due to an elastic return operation thereof. Thus the distinguishing part 46 is visible. In this case, the distinguishing part 46 is clearly visible from the distinguishing position due to the different colors of the distinguishing part 46 and the to-be-guided part 52 forming the background color.

Therefore, the distinguishing part 46 is visible from the distinguishing position, and it is possible to determine that the fit-on detector 50 has reached the detection position. Consequently it is possible to prevent the operation of moving the fit-on detector 50 to the detection position from being neglected.

The distinguishing part 46 is exposed rapidly and is clearly visible due to the elastic return of the flexing strip 41. Thus it is possible to distinguish clearly whether the fit-on detector 50 has reached the detection position. More particularly, the distinguishing part 46 rides across the interference part 63 at the detection position and is visible from the distinguishing position to distinguish clearly whether the fit-on detector 50 has reached the detection position.

The entire flexing strip 41 always is exposed and the flexed state of the flexing strip 41 indicates that the fit-on detector 50 has not reached the detection position.

The fit-on detector 50 is inserted and guided in the guide space 45 between the sliding surface 37 of the housing 20 and the flexing strip 41. This guide construction is simpler than a guide construction for guiding the fit-on detector 50 that is formed separately from the flexing strip 41. Further, the two to-be-guided parts 52 are formed on the fit-on detector 50 at both sides of the operation surface 60 in its width direction so that the to-be-guided parts 52 are inserted and guided in the left and right guide spaces 45. Therefore the pressed fit-on detector 50 can reach the detection position smoothly and securely without a position gap.

The short circuit terminal 90 is mounted on the fit-on detector 50, the short-circuited state of a pair of the terminal fittings 80 is released due to the movement of the fit-on detector 50. Consequently it is unnecessary to form a construction for releasing the short-circuited state on the mating housing 100. Further because the short circuit terminal 90 serves as the detection terminal, the above-described construction is simpler than a construction where the detection terminal is separate.

At the wait position, because the interference part 63 contacts the distinguishing part 46 of the flexing strip 41 from the rear side thereof, the movement of the fit-on detector 50 to the detection position is prevented. Therefore it is possible to enhance the reliability in the performance of the movement prevention construction composed of the contact portion 57 and the elastic locking part 28 and the reliability in holding the fit-on detector 50 at the wait position in the movement-prevented state.

The interference part 63 contacts the distinguishing part 46 of the flexing strip 41 from the front at the detection position to prevent the fit-on detector 50 from moving to the wait position. Therefore it is unnecessary to form a separate movement prevention construction for preventing the return of the fit-on detector 50 to the wait position.

Furthermore the distinguishing part 46 is positioned alongside the operation surface 60 so that an operator's fingers will not interfere with the distinguishing part 46. In addition, the distinguishing part 46 is positioned in the direction in which the operator presses the distinguishing part 46. Thus, the distinguishing part 46 is easily visible from the distinguishing position where the operator stands.

The invention is not limited to the embodiments described above with reference to the drawings. For example, the following embodiments are also included in the technical scope of the present invention.

The distinguishing part may be exposed at the wait position when seen from the distinguishing position, whereas the distinguishing part may be hidden at the detection position when seen from the distinguishing position.

The flexing strip may be formed on the fit-on detector, and the interference part may be formed on the housing.

At the detection position, the flexing strip may be placed in a state immediately before the flexing strip completely returns to its original state.

The color of the entire fit-on detector need not be different from the housing, but only the color of the distinguishing part may be different from the housing.

At the detection position, separately from the interference part and the flexing strip, it is possible to form a construction for preventing the fit-on detector from returning to the wait position. This construction enhances the reliability in holding the fit-on detector at the detection position in the state in which the fit-on detector is prevented from returning to the wait position.

What is claimed is:

1. A connector comprising:

a housing fittable on a mating housing, and a fit-on detector mounted on the housing for movement between a wait position and a detection position, the fit-on detector being held in the wait position in a process of fitting the housing and the mating housing together, and is allowed to move to the detection position when the housing and the mating housing have been fit together properly, at least one flexing strip being formed on one of the housing and the fit-on detector, an interference part formed on other of said housing and said fit-on detector, and a distinguishing part formed on the flexing strip and having a color different from a color of the other of the housing and said fit-on detector;

the flexing strip interfering with the interference part in a process of moving said fit-on detector from the wait position to the detection position and being elastically deformed;

the flexing strip being released from the interference part and being elastically restored to an original state when the fit-on detector has reached the detection position; and a position of the distinguishing part relative to the interference part changes before and after the flexing strip flexes, whereby the distinguishing part is exposed or hidden when the connector is viewed from a distinguishing position.

2. The connector of claim 1, wherein the distinguishing part interferes with the interference part in a process of moving the fit-on detector from the wait position to the detection position, and said distinguishing part rides across the interference part at said detection position and is exposed when viewed from the distinguishing position.

3. The connector of claim 1, wherein the flexing strip always is exposed.

4. The connector of claim 1, wherein the flexing strip is formed on the housing, and a guide space is formed between the flexing strip and a surface of the housing for receiving and guiding fit-on detector.

5. The connector of claim 4, further comprising a plurality of terminal fittings accommodated inside the housing and an opening formed on the surface of the housing for exposing the terminal fittings, a short circuit terminal accommodated in said fit-on detector at a position opposed to the surface of the housing and contacting a pair of the terminal fittings through the opening at the wait position and is released from the pair of the terminal fittings at the detection position.

6. The connector of claim 5, wherein the short circuit terminal is a detection terminal for opening a detection circuit at the detection position.

7. The connector of claim 4, wherein the interference part contacts the flexing strip at the wait position and prevents a movement of the fit-on detector to the detection position.

8. The connector of claim 7, wherein the interference part contacts the flexing strip at the detection position and prevents a return movement of the fit-on detector to the wait position.

9. The connector of claim 4, further comprising an operation surface formed on the fit-on detector and being disposed to be pressed for moving the fit-on detector from the wait position toward the detection position, said distinguishing part being positioned alongside the operation surface.

10. The connector of claim 9, wherein the at least one flexing strip comprises two of the flexing strips formed respectively at opposite sides of the housing in a width direction thereof, and two to-be-guided parts being formed at opposite sides of the operation surface in a width direction of the fit-on detector so that the to-be-guided parts are inserted and guided in guide spaces formed between the flexing strips and a surface of said housing.

* * * * *